US011326770B2

(12) United States Patent
Lei et al.

(10) Patent No.: US 11,326,770 B2
(45) Date of Patent: May 10, 2022

(54) UNDER CABINET LIGHT INTERFACE DEVICE AND LIGHTING DEVICE INTERFACE DEVICE

(71) Applicant: SAVANT TECHNOLOGIES LLC, East Cleveland, OH (US)

(72) Inventors: Ming Lei, Shanghai (CN); Huisheng Zhou, Shanghai (CN); Yao Fu, Shanghai (CN); Yin Suo, Shanghai (CN); Fanbin Wang, Shanghai (CN); Jiakang Lv, Shanghai (CN)

(73) Assignee: SAVANT TECHNOLOGIES LLC, East Cleveland, OH (US)

( * ) Notice: Subject to any disclaimer, the term of this patent is extended or adjusted under 35 U.S.C. 154(b) by 0 days.

(21) Appl. No.: 17/365,488

(22) Filed: Jul. 1, 2021

(65) Prior Publication Data

US 2022/0003404 A1 Jan. 6, 2022

(30) Foreign Application Priority Data

Jul. 1, 2020 (CN) ..... 202010619473.5

(51) Int. Cl.
*F21V 33/00* (2006.01)
*A47B 96/00* (2006.01)
(Continued)

(52) U.S. Cl.
CPC ..... *F21V 33/0012* (2013.01); *A47B 96/00* (2013.01); *F21V 23/003* (2013.01);
(Continued)

(58) Field of Classification Search
CPC ..... F21V 33/0012; F21V 23/003; F21V 23/06
(Continued)

(56) References Cited

U.S. PATENT DOCUMENTS 10,973,099 B1 * 4/2021 Peng ..... H05B 45/44
2016/0374168 A1 * 12/2016 Ackmann ..... H05B 45/14
(Continued)

*Primary Examiner* — Bryon T Gyllstrom
(74) *Attorney, Agent, or Firm* — Wood IP LLC

(57) ABSTRACT

The present application relates to an under cabinet light interface device and lighting device interface device, the under cabinet light interface device includes: a power input interface, configured to be connected to an under cabinet light power source, so as to acquire an input alternating current from the under cabinet light power source; a power output module, configured to receive, by means of a circuit, the input alternating current from the power input interface, convert the input alternating current into an output current, and output the output current to appliances connected to the power output module; a dimmer detection module, provided between the power input interface and the power output module, and is configured to detect whether a dimmer is connected to the power input interface; and a first switch device, provided between the power input interface and the power output module, and configured to: disconnect a circuit connection between the power input interface and the power output module if the dimmer detection module detects that a dimmer is connected to the power input interface, and conduct the circuit connection between the power input interface and the power output module if the dimmer detection module detects that no dimmer is connected to the power input interface.

11 Claims, 7 Drawing Sheets

(51) Int. Cl.
*F21V 23/00* (2015.01)
*F21V 23/06* (2006.01)
*F21W 131/301* (2006.01)

(52) U.S. Cl.
CPC ..... *F21V 23/06* (2013.01); *A47B 2220/0077* (2013.01); *F21W 2131/301* (2013.01)

(58) Field of Classification Search
USPC ..... 362/133
See application file for complete search history.

(56) References Cited

U.S. PATENT DOCUMENTS

| | | | | |
|---|---|---|---|---|
| 2017/0280532 | A1* | 9/2017 | Akiyama | H05B 45/46 |
| 2018/0160509 | A1* | 6/2018 | Treible, Jr. | F21V 17/02 |
| 2019/0098723 | A1* | 3/2019 | Sadwick | H05B 45/3578 |
| 2020/0084851 | A1* | 3/2020 | Kuo | F21V 23/003 |
| 2020/0271279 | A1* | 8/2020 | Xiong | F21V 3/061 |
| 2020/0375000 | A1* | 11/2020 | Reed | H05B 47/11 |

* cited by examiner

UNDER CABINET LIGHT INTERFACE DEVICE AND LIGHTING DEVICE INTERFACE DEVICE

TECHNICAL FIELD

The present application relates to the field of under cabinet lights, and in particular to an under cabinet light interface device and lighting device interface device.

BACKGROUND

A problem that it is difficult to find a power outlet nearby may be faced when an under cabinet light is wired. If the under cabinet light is connected to the power outlet, one power outlet may be occupied by the under cabinet light, so that the number of the available power outlets is reduced. Electrical appliances usually need to be connected to the power outlet, but a power wiring board is limited by the length of a power line, so the layout of the power outlet is limited too, it is often difficult for a user to find a suitable position to install the power outlet.

The under cabinet light may be connected to a dimmer for adjusting the brightness of the under cabinet light. Equipment, such as the power outlet and a Universal Serial Bus (USB) charger, is not compatible with the dimmer of the under cabinet light. The equipment, such as the power outlet and the USB charger, may provide power to the connected appliances, but if the dimmer is mistakenly connected by a user to a circuit system in which the equipment, such as the power outlet and the USB charger, is located, the appliances which are powered may be damaged, and the dimmer may also be damaged.

SUMMARY

The embodiment of the present application provides an under cabinet light interface device and lighting device interface device, so as to at least solve a problem of inconvenient connection between a lighting device, an under cabinet light and an electrical appliance and a power source.

According to one aspect of the embodiment of the present application, an under cabinet light interface device is provided, including: a power input interface, configured to be connected to an under cabinet light power source, so as to acquire an input alternating current from the under cabinet light power source; a power output module, configured to receive, by means of a circuit, the input alternating current from the power input interface, convert the input alternating current into an output current, and output the output current to one or more appliances connected to the power output module; a dimmer detection module, provided between the power input interface and the power output module, and configured to detect whether a dimmer is connected to the power input interface; and a first switch device, provided between the power input interface and the power output module, and configured to: disconnect a circuit connection between the power input interface and the power output module if the dimmer detection module detects that a dimmer is connected to the power input interface, and conduct the circuit connection between the power input interface and the power output module if the dimmer detection module detects that no dimmer is connected to the power input interface.

In such a mode, when it is detected that the dimmer is connected to the circuit system in which the under cabinet light interface device is located, an internal power transmission path of the under cabinet light interface device is disconnected, so as to avoid power from being transmitted to the appliance connected with the under cabinet light interface device, and to avoid the appliance or the dimmer from being damaged.

According to an exemplary embodiment of the present application, the power output module includes: an alternating current—alternating current conversion module, configured to convert the input alternating current into one or more output alternating currents; one or more alternating current output interfaces, configured to output the one or more output alternating currents to one or more appliance connected to the one or more alternating current output interfaces; an alternating current—direct current conversion module, configured to convert the input alternating current into a constant direct current; a direct current output control module, configured to convert the constant direct current into one or more output direct currents; and one or more direct current output interfaces, configured to output the one or more output direct currents to one or more appliance connected to the one or more direct current output interfaces.

In such a mode, the under cabinet light interface device may provide corresponding direct current power or alternating current power to the connected appliance.

According to an exemplary embodiment of the present application, the power output module includes: a second switch device, provided between the first switch device and the alternating current—direct current conversion module, and is configured to control closing or opening of a circuit between the first switch device and the power output module.

In such a mode, the under cabinet light interface device may be controlled by the switch, so the power transmission path is connected or disconnected according to the need, and the power is provided to the appliance selectively.

According to an exemplary embodiment of the present application, the under cabinet light interface device further includes an alarm device, the alarm device is configured to: issue an alarm signal if the dimmer detection module detects that a dimmer is connected to the power input interface.

In such a mode, the under cabinet light interface device, by means of warning, may remind the user that the dimmer exists in the circuit, thereby the safety is improved.

According to an exemplary embodiment of the present application, the under cabinet light interface device further includes an overload protection device, the overload protection device is configured to: acquire a power load value of the under cabinet light interface device; compare the power load value with a safety load value of the under cabinet light interface device; and disconnect the circuit connection between the power input interface and the power output module if the power load value exceeds the safety load value of the under cabinet light interface device.

In such a mode, the under cabinet light interface device may disconnect the power transmission path when the load of the appliance connected in the circuit exceeds a safe load value, thereby the appliance in the circuit is protected.

According to an exemplary embodiment of the present application, the under cabinet light interface device further includes a wrong insertion protection device, the wrong insertion protection device is configured to: detect whether an appliance connected to the power output module matches the power output module; and control the power output module not to output a current to the appliance which does not match if the appliance connected to the power output module does not match the power output module.

In such a mode, the under cabinet light interface device may provide the power to the matched appliance.

According to an exemplary embodiment of the present application, the dimmer detection module is configured to: acquire a predetermined waveform when a dimmer is connected to the power input interface; detect an input waveform of the input alternating current; and compare whether the input waveform matches the predetermined waveform, so as to detect whether a dimmer is connected to the power input interface.

In such a mode, it may be detected whether the dimmer is connected to the circuit in which the under cabinet light interface device is located.

According to an exemplary embodiment of the present application, at least one of the alternating current output interfaces is configured to be connectable to an under cabinet light and provide power to the under cabinet light.

In such a mode, the under cabinet light interface device can provide convenient connection for the under cabinet light.

According to another one aspect of the embodiment of the present application, a lighting device interface device is provided, comprising: a power input interface, configured to be connected to a lighting device, so as to acquire an input alternating current from the lighting device; a power output module, configured to receive, by means of a circuit, the input alternating current from the power input interface, convert the input alternating current into an output current, and output the output current to one or more appliances connected to the power output module; a dimmer detection module, provided between the power input interface and the power output module, and configured to detect whether a dimmer is connected to the power input interface; and a first switch device, provided between the power input interface and the power output module, and configured to: disconnect a circuit connection between the power input interface and the power output module if the dimmer detection module detects that a dimmer is connected to the power input interface, and conduct the circuit connection between the power input interface and the power output module if the dimmer detection module detects that no dimmer is connected to the power input interface.

In such a mode, when it is detected that the dimmer is connected to the circuit system in which the lighting device interface device is located, an internal power transmission path of the lighting device interface device is disconnected, so as to avoid power from being transmitted to the appliance connected with the lighting device interface device, and to avoid the appliance or the dimmer from being damaged.

According to an exemplary embodiment of the present application, the power output module comprises: an alternating current—alternating current conversion module, configured to convert the input alternating current into one or more output alternating currents; one or more alternating current output interfaces, configured to output the one or more output alternating currents to one or more appliance connected to the one or more alternating current output interfaces; an alternating current—direct current conversion module, configured to convert the input alternating current into a constant direct current; a direct current output control module, configured to convert the constant direct current into one or more output direct currents; and one or more direct current output interfaces, configured to output the one or more output direct currents to one or more appliance connected to the one or more direct current output interfaces.

In such a mode, the lighting device interface device may provide corresponding direct current power or alternating current power to the connected appliance.

According to an exemplary embodiment of the present application, the dimmer detection module is configured to: acquire a predetermined waveform when a dimmer is connected to the power input interface; detect an input waveform of the input alternating current; and compare whether the input waveform matches the predetermined waveform, so as to detect whether a dimmer is connected to the power input interface.

In such a mode, it may be detected whether the dimmer is connected to the circuit in which the lighting device interface device is located.

In the embodiment of the present application, a dimmer detection function of the under cabinet light interface device and lighting device interface device is provided, and the power transmission path is automatically disconnected when the dimmer is connected in the circuit, so as to stop providing the power to the appliance connected to the under cabinet light interface device and lighting device interface device, so that a technical problem that the appliance or the dimmer is easily damaged when the dimmer is connected to the circuit system in which the under cabinet light interface device and lighting device interface device is located is solved at least, and the technical effect of improving the safety of the under cabinet light and lighting device circuit system is achieved.

BRIEF DESCRIPTION OF THE DRAWINGS

The accompanying drawings described herein are used to provide a further understanding of the application, and constitute a part of the application, and the exemplary embodiments of the application and the description thereof are used to explain the application, but do not constitute improper limitations to the application. In the drawings.

EXPLANATORY NOTE OF THE DRAWINGS

Figure 1:
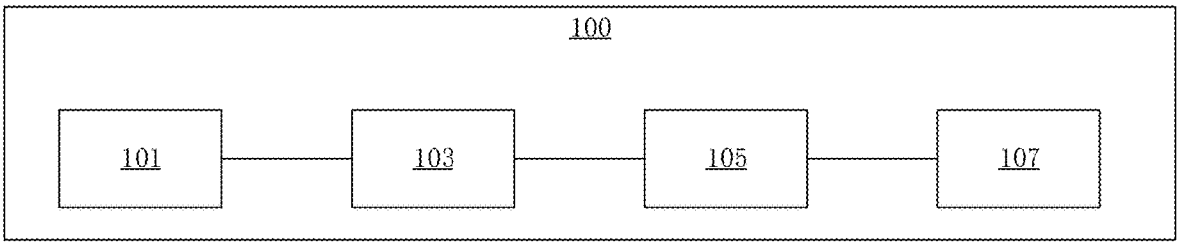
FIG. 1 is a schematic diagram of an under cabinet light interface device according to an embodiment of the present application.

100, Under cabinet light interface device;
101, Power input interface;
103, First switch device;
105, Dimmer detection module;
107, Power output module;
1071, 1073, Alternating current output interface;
1075, Alternating current—direct current conversion module;
1077, Direct current output control module;
1078, 1079, Direct current output interface;
109, Second switch device;
110, Alternating current output interface;
111, Alarm device;
130, USB-A interface;
150, USB-C interface;
200, Under cabinet light; and
300, power cable.

DETAILED DESCRIPTION OF THE EMBODIMENTS

In order to make those skilled in the art better understand the solutions of the application, the technical solutions in the embodiments of the application will be clearly and completely described below with reference to the drawings in the embodiments of the application. It is apparent that the described embodiments are only a part of the embodiments of the application, not all of the embodiments. All other embodiments obtained by those of ordinary skill in the art based on the embodiments of the application without creative efforts should fall within the scope of protection of the application.

It is to be noted that the specification and claims of the application and the terms "first", "second" and the like in the drawings are used to distinguish similar objects, and do not need to describe a specific sequence or a precedence order. It will be appreciated that data used in such a way may be exchanged under appropriate conditions, in order that the embodiments of the application described here can be implemented in a sequence other than sequences graphically shown or described here. In addition, terms "include" and "have" and any variations thereof are intended to cover non-exclusive inclusions. For example, it is not limited for processes, methods, systems, products or devices containing a series of steps or modules or units to clearly list those steps or modules or units, and other steps or modules or units which are not clearly listed or are inherent to these processes, methods, products or devices may be included instead.

According to an embodiment of the present application, an under cabinet light interface device is provided. FIG. 1 is a schematic diagram of the under cabinet light interface device according to the embodiment of the present application. As shown in FIG. 1, the under cabinet light interface device 100 according to the embodiment of the present application includes: a power input interface 101, a first switch device 103, a dimmer detection module 105 and a power output module 107.

The power input interface 101 is configured to be connected to an under cabinet light power source or other lighting device, so as to acquire an input alternating current from the under cabinet light power source or lighting device. The power input interface 101 is connected with an under cabinet light according to a preferable embodiment, and the under cabinet light is taken as an example to explain the embodiment of the invention later. The power input interface 101 can be connected to the under cabinet light through a power cable and its connection device, or directly to the connection device on the under cabinet light. When the under cabinet light interface device 100 is connected between the two adjacent under cabinet lights, it can connect the two adjacent under cabinet lights and provide power plug function of other electrical devices. The under cabinet light interface unit 100 can also draw power directly from the wall socket by connecting the power cable.

See FIG. 7 to FIG. 10 for the under cabinet light interface device and the exemplary connection mode between the under cabinet light interface device and the under cabinet.

Figure 7:
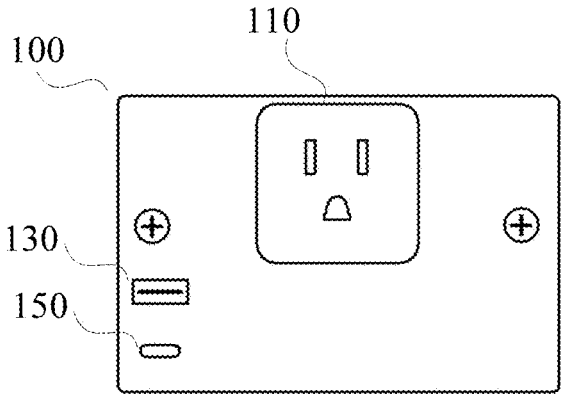
FIG. 7 is a plane diagram of the under cabinet light interface device according to an exemplary embodiment of the present application.
Figure 8:
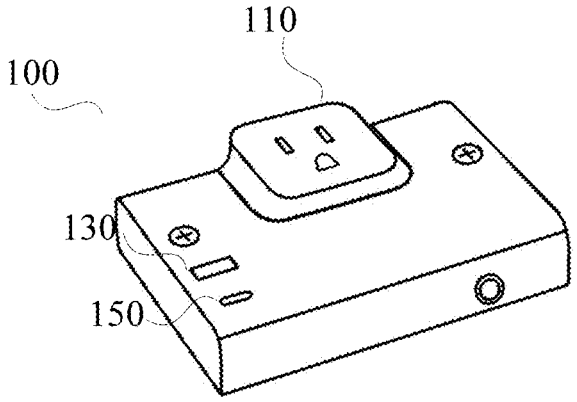
FIG. 8 is a three-dimensional diagram of the under cabinet light interface device according to an exemplary embodiment of the present application.
Figure 9:
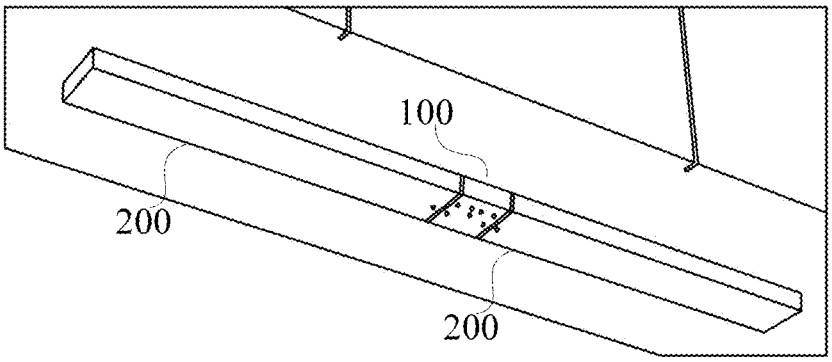
FIG. 9 is a schematic diagram of the connection between the under cabinet light interface device and the under cabinet light according to an exemplary embodiment of the present application.
Figure 10:
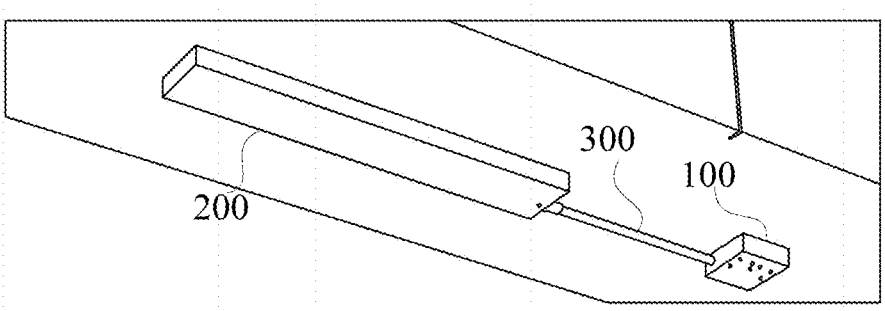
FIG. 10 is a schematic diagram of the connection between the under cabinet light interface device and the under cabinet light according to another exemplary embodiment of the present application.

As shown in FIG. 7 and FIG. 8, under cabinet light interface device 100 includes alternating current output interface 110, USB-A interface 130 and USB-C interface 150, which are used to provide power to connected appliances. In addition, the under cabinet light interface unit 100 can be connected to the under cabinet light to provide or obtain electricity. As shown in FIG. 9, the under cabinet light interface device 100 can be directly set between two under cabinet lights 200 to realize the electrical connection between the two cabinet lights 200, and provide power plug function of other electrical devices. As shown in FIG. 10, the under cabinet light interface device 100 can be connected to a under cabinet light 200 through power cable 300, so as to realize the electrical connection to the under cabinet light 200 and provide power plug function of other electrical devices.

The power output module 107 is configured to receive, by means of a circuit, the input alternating current from the power input interface 101, convert the input alternating current into an output current, and output the output current to one or more appliances connected to the power output module 107.

The dimmer detection module 105 is provided between the power input interface 101 and the power output module 107, and is configured to detect whether a dimmer is connected to the power input interface 101.

The first switch device 103 is provided between the power input interface 101 and the power output module 107, and is configured to: disconnect a circuit connection between the power input interface 101 and the power output module 107 if the dimmer detection module 105 detects that a dimmer is connected to the power input interface 101, and conduct the circuit connection between the power input interface 101 and the power output module 107 if the dimmer detection module 105 detects that no dimmer is connected to the power input interface 101. The first switching device 103 can be a relay or an electronic or mechanical switching device with similar functions, which realize open and close of the circuit according to the detection results of the detection module. The dimmer can be installed on the wall or connected to the under cabinet light in other ways and provide dimming signal for the under cabinet light.

In such a mode, when it is detected that the dimmer is connected to the circuit system in which the under cabinet light interface device is located, an internal power transmission path of the under cabinet light interface device is disconnected, so as to avoid power from being transmitted to the appliance connected with the under cabinet light interface device, and to avoid the appliance or the dimmer from being damaged.

Figure 2:
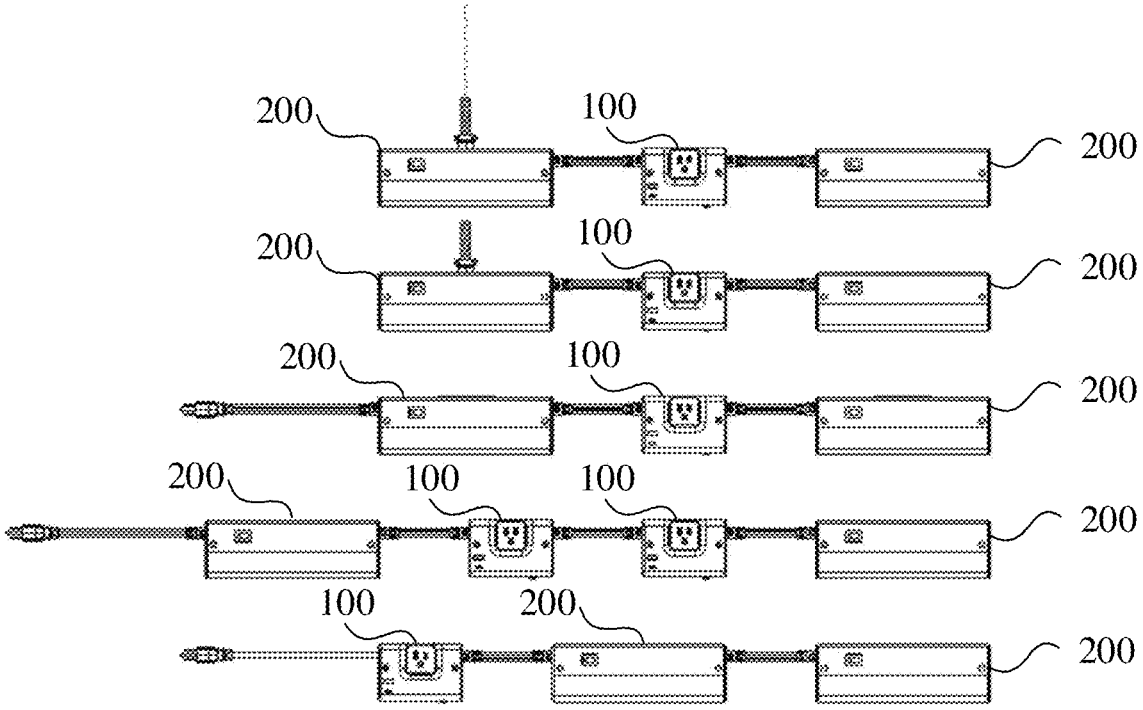
FIG. 2 is a schematic diagram of a connection mode of the under cabinet light interface device according to the embodiment of the present application.

FIG. 2 is a schematic diagram of a connection mode of the under cabinet light interface device according to the embodiment of the present application. As shown in FIG. 2, the under cabinet light interface device 100 according to the embodiment of the present application is connected with an under cabinet light 200. The under cabinet light interface device 100 may be connected between the under cabinet light 200 and a power outlet, between the under cabinet light 200 and the other under cabinet light interface device 100, and between the under cabinet light 200 and the under cabinet light 200, or connected to a far-end, away from the power outlet, of a series of the under cabinet lights 200. In such a connection mode, the under cabinet light interface device 100 may be powered from the under cabinet light 200 or powered from the power outlet, for example, the power input interface 101 is directly or indirectly connected with an under cabinet light power source according to the above mode, so that power is provided to the under cabinet light 200 or other appliances connected with the power output module 107 of the under cabinet light interface device 100. The under cabinet light interface device 100 provides the flexibility for the power connection mode of the under cabinet light 200, thereby the additional and convenient power input interface and/or power output interface is provided near the under cabinet light.

Figure 3:
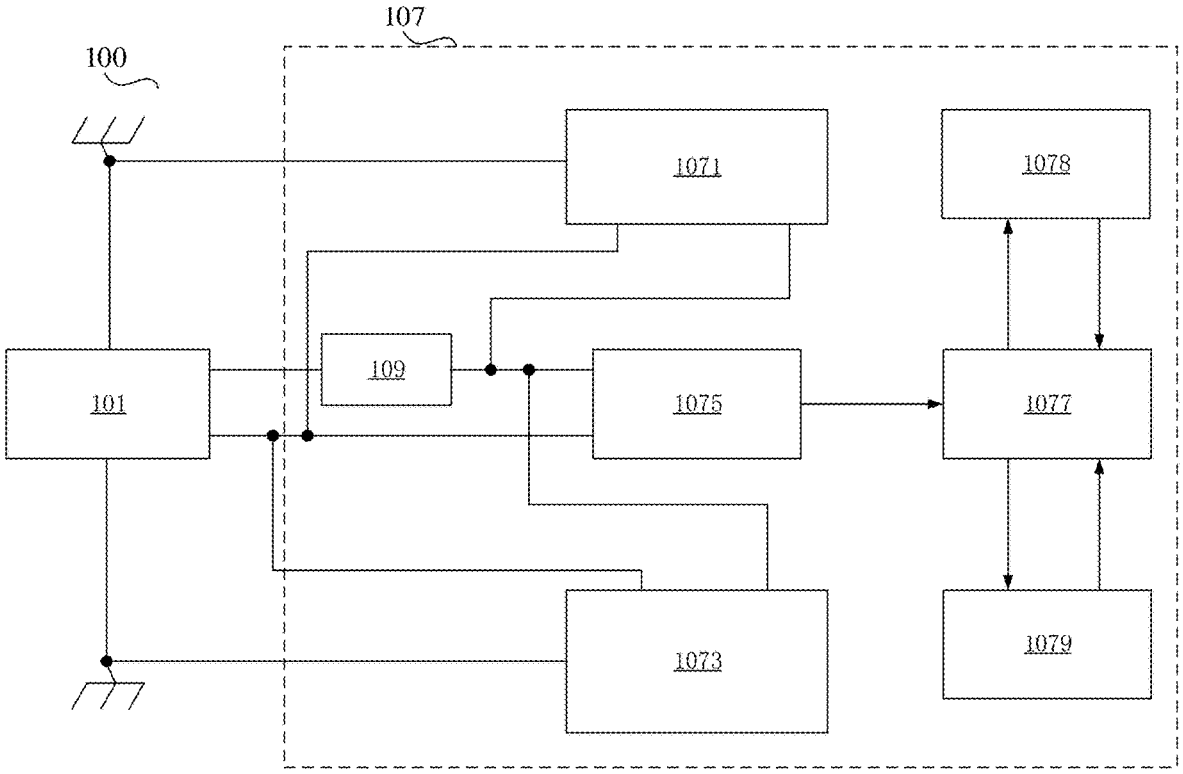
FIG. 3 is a circuit diagram of the under cabinet light interface device according to an exemplary implementation mode of the present application.
Figure 4:
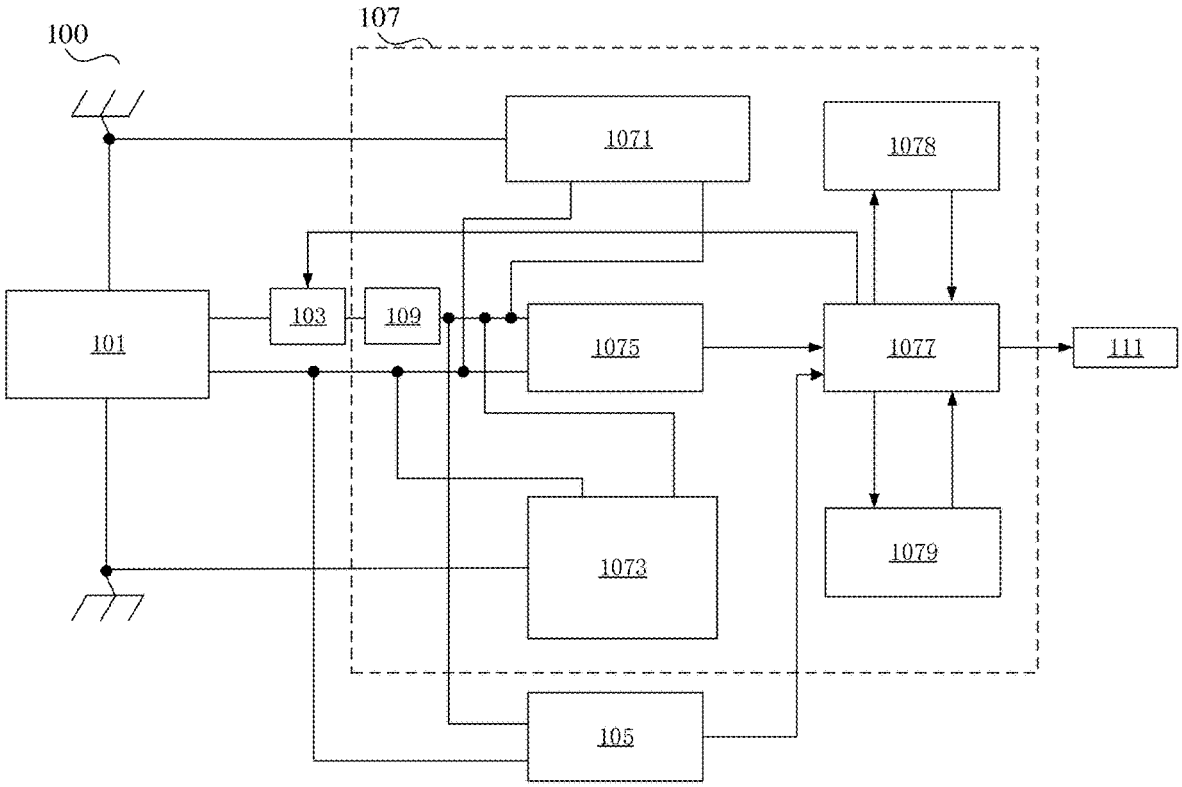
FIG. 4 is a circuit diagram of the under cabinet light interface device according to another exemplary implementation mode of the present application.

FIG. 3 is a circuit diagram of the under cabinet light interface device according to an exemplary implementation mode of the present application, and FIG. 4 is a circuit diagram of the under cabinet light interface device according to another exemplary implementation mode of the present application. As shown in FIG. 3, the under cabinet light interface device 100 according to the exemplary implementation mode of the present application in FIG. 3 includes the power input interface 101 and the power output module 107. As shown in FIG. 4, the under cabinet light interface device 100 according to another exemplary implementation mode of the present application in FIG. 4 includes the power input interface 101, a first switch device 103, a dimmer detection module 105 and the power output module 107.

As shown in FIG. 3 and FIG. 4, according to the exemplary embodiment of the present application, the power output module 107 includes an alternating current—alternating current conversion module (not shown), alternating current output interfaces 1071 and 1073 (two are shown schematically, and one or more alternating current output interfaces may be provided), an alternating current—direct current conversion module 1075, a direct current output control module 1077, and direct current output interfaces 1078 and 1079 (two are shown schematically, and one or more direct current output interfaces may be provided).

The alternating current—alternating current conversion module is configured to convert the input alternating current into one or more output alternating currents.

One or more alternating current output interfaces 1071 and 1073 are configured to output the one or more output alternating currents to one or more appliance connected to the one or more alternating current output interfaces.

The alternating current—direct current conversion module 1075 is configured to convert the input alternating current into a constant direct current. For example, the alternating current—direct current conversion module 1075 may use a Flyback constant direct current conversion device (Fly Back CV) to convert the alternating current into the constant direct current.

The direct current output control module 1077 is configured to convert the constant direct current into one or more output direct currents. For example, the direct current output control module 1077 may use a PD QC power controller to provide the corresponding direct current to the direct current output interface.

One or more direct current output interfaces 1078 and 1079 are configured to output the one or more output direct currents to one or more appliance connected to the one or more direct current output interfaces. For example, the direct current output interfaces 1078 and 1079 may use USB-A or USB-C, or the direct current output interfaces in other specifications. In such a mode, the under cabinet light interface device may provide corresponding direct current power or alternating current power to the connected appliance.

As shown in FIG. 3 and FIG. 4, according to the exemplary embodiment of the present application, the power output module 107 further includes: a second switch device 109.

As shown in FIG. 3, the second switch device 109 is provided between the power input interface 101 and the alternating current—direct current conversion module 1075, and is configured to control closing or opening of a circuit between the power input interface 101 and the power output module 107.

As shown in FIG. 4, the second switch device 109 is provided between the first switch device 103 and the alternating current—direct current conversion module 1075, and is configured to control closing or opening of a circuit between the first switch device 103 and the power output module 107. For example, the second switch device 109 may use a breaker. When a user needs or does not need the under cabinet light interface device to provide usable power, the second switch device 109 may be opened or closed, thereby power transmission is connected or disconnected. In such a mode, the under cabinet light interface device may be controlled by the switch, so the power transmission path is connected or disconnected according to the need, and the power is provided to the appliance selectively.

As shown in FIG. 4, the under cabinet light interface device 100 according to another exemplary implementation mode of the present application includes a dimmer detection module 105. The dimmer detection module 105 is configured to: acquire a predetermined waveform when a dimmer 103 is connected to the power input interface 101, detect an input waveform of the input alternating current, and compare whether the input waveform matches the predetermined waveform, so as to detect whether a dimmer is connected to the power input interface. In such a mode, it may be detected whether the dimmer is connected to the circuit in which the under cabinet light interface device is located.

Figure 5:
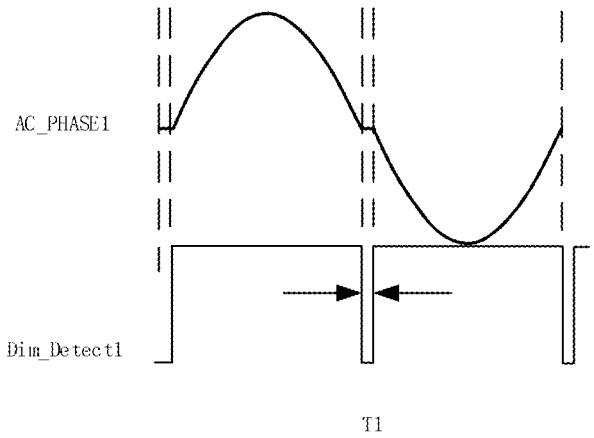
FIG. 5 is a schematic diagram of a power waveform detected when no dimmer is connected to a circuit according to the exemplary implementation mode of the present application.
Figure 6:
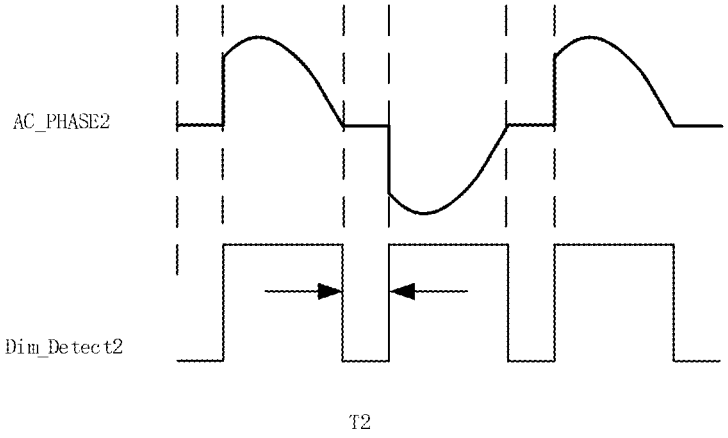
FIG. 6 is a schematic diagram of the power waveform detected when a dimmer is connected to the circuit according to the exemplary implementation mode of the present application.

A technical scheme of the present application may use various dimmer detection modes. FIG. 5 is a schematic diagram of a power waveform detected when no dimmer is connected to a circuit according to the exemplary implementation mode of the present application. FIG. 6 is a schematic diagram of the power waveform detected when a dimmer is connected to the circuit according to the exemplary implementation mode of the present application.

As shown in FIG. 5, FIG. 5 shows an alternating current waveform AC_PHASE1 when no dimmer is connected to the circuit, and a corresponding detector waveform is Dim_Detect1. The detector waveform Dim_Detect1 shows whether a phase of the alternating current waveform AC_PHASE1 is changed. In a period T1, the detector waveform Dim_Detect1 shows that the alternating current waveform AC_PHASE1 is not changed and is a zero value.

As shown in FIG. 6, FIG. 6 shows an alternating current waveform AC_PHASE2 when a dimmer is connected to the circuit, and a corresponding detector waveform is Dim_Detect2. The detector waveform Dim_Detect2 shows whether a phase of the alternating current waveform AC_PHASE2 is changed. In a period T2, the detector waveform Dim_Detect2 shows that the alternating current waveform AC_PHASE2 is not changed and is a zero value.

If the input waveform of the alternating current detected by the dimmer detection module 105 matches with the alternating current waveform AC_PHASE2 when the dimmer is connected to the circuit, it is determined that there is a dimmer connected with the power input interface.

In another embodiment, if zero phase time between two waves of the detected alternating current input waveform is changed, for example, the zero phase time between two waves of the detected alternating current input waveform is prolonged, it is determined that there is a dimmer connected with the power input interface. As mentioned above, when the dimmer detection module 105 detects that a dimmer is working, the first switch device 103 is configured to disconnect the circuit between the power input interface 101 and the power output module 107 to achieve circuit protection.

The dimmer detection module 105 according to the embodiment of the present application may also use other modes, as long as it may be determined that there is a dimmer connected with the power input interface.

As shown in FIG. 4, the under cabinet light interface device 100 according to another exemplary implementation mode of the present application further includes an alarm device 111. The alarm device 111 is configured to: issue an alarm signal if the dimmer detection module 105 detects that a dimmer is connected to the power input interface 101. For example, the alarm device 111 may issue the alarm signal by means of a buzzer or lamplight (for example LED). In such a mode, the under cabinet light interface device, by means of warning, may remind the user that the dimmer exists in the circuit, thereby the safety is improved.

According to an exemplary embodiment of the present application, the under cabinet light interface device further includes an overload protection device, the overload protection device is configured to: acquire a power load value of the under cabinet light interface device; compare the power load value with a safety load value of the under cabinet light interface device; and disconnect the circuit connection between the power input interface and the power output module if the power load value exceeds the safety load value of the under cabinet light interface device. In such a mode, the under cabinet light interface device may disconnect the power transmission path when the load of the appliance connected in the circuit exceeds a safe load value, thereby the appliance in the circuit is protected.

According to an exemplary embodiment of the present application, the under cabinet light interface device further includes a wrong insertion protection device, the wrong insertion protection device is configured to: detect whether an appliance connected to the power output module matches the power output module; and control the power output module not to output a current to the appliance which does not match if the appliance connected to the power output module does not match the power output module. For example, it may be determined whether the appliance matches with the power output module by means of detecting whether a plug of the appliance matches with an outlet of the under cabinet light interface device, and detecting whether input voltage or current of the appliance matches with voltage or current provided by the under cabinet light interface device. In such a mode, the under cabinet light interface device may provide the power to the matched appliance.

According to the implementation mode of the present application, the under cabinet light interface device may be connected with the under cabinet light, the power outlet and the appliance, thereby the power is provided to the under cabinet light and the appliance. In addition, the under cabinet light interface device may be connected between multiple under cabinet lights, may also be connected with other under cabinet light interface devices, thereby extended using space is provided to the under cabinet light power source. The under cabinet light interface device provides one or more power source interfaces to the appliance, and it is convenient for the user. The under cabinet light interface device may provide one or more USB interfaces so that a quick charge function of a device is provided.

Furthermore, the under cabinet light interface device is provided with the overload protection device capable of avoiding the circuit from being damaged because of excessive load. The under cabinet light interface device is provided with the dimmer detection device, so that the appliance and the dimmer are protected when the dimmer is connected to the circuit. The under cabinet light interface device is provided with the alarm device, so that it reminds the user by means of warning that the dimmer exists in the circuit. The under cabinet light interface device further includes the wrong insertion protection device, so that an interface of the under cabinet light interface device is protected.

It should be understood that the under cabinet light interface device may be connected with the under cabinet light by means of a connecting line or the interface.

In the above embodiments of the application, descriptions of each embodiment are emphasized respectively, and parts which are not elaborated in detail in a certain embodiment may refer to relevant descriptions of other embodiments.

In several embodiments provided by the application, it is to be understood that the disclosed technical content may be implemented in other manners. The apparatus embodiments described above are merely illustrative. For example, the division of the unit or module is only a logical function division. In actual implementation, there may be another division manner, for example, multiple units or modules may be combined or integrated into another system, or some features may be ignored or not executed. In addition, the coupling or direct coupling or communication connection shown or discussed may be an indirect coupling or communication connection through some interfaces, modules or units, and may be electrical or otherwise.

The units or modules described as separate components may or may not be physically separated, and the members displayed as units or modules may or may not be physical units or modules, that is, may be located in one place, or may be distributed to multiple network units or modules. Some or all of the units or modules may be selected according to actual needs to achieve the purpose of the solution of the present embodiment.

In addition, each functional unit or module in each embodiment of the application may be integrated into a processing unit or module, each unit or module may also physically exist independently, and two or more than two units or modules may also be integrated into a unit or module. The integrated unit or module may be implemented in a hardware form and may also be implemented in the form of a software functional unit or module.

The integrated unit may be stored in a computer-readable storage medium if being implemented in the form of a software functional unit and sold or used as a standalone product. Based on such an understanding, the technical solution of the application, which is essential or contributes to the conventional art, may be embodied in the form of a software product. The computer software product is stored in a storage medium, including a number of instructions for causing a terminal device (which may be a personal computer, a server, or a network device, etc.) to perform all or part of the steps of the methods described in various embodiments of the application. The foregoing storage medium includes: a U disk, a Read-Only Memory (ROM), a Random Access Memory (RAM), a mobile hard disk, a magnetic disk, or an optical disk, and the like, which may store a program code.

The above is a preferred implementation of the application. It is to be noted that a number of modifications and refinements may be made by those of ordinary skill in the art without departing from the principles of the application, and such modifications and refinements are also considered to be within the scope of protection of the application.

What is claimed is:

1. An under cabinet light interface device, comprising:

a power input interface, configured to be connected to an under cabinet light power source, so as to acquire an input alternating current from the under cabinet light power source;

a power output module, configured to receive, by means of a circuit, the input alternating current from the power input interface, convert the input alternating current into an output current, and output the output current to one or more appliances connected to the power output module;

a dimmer detection module, provided between the power input interface and the power output module, and configured to detect whether a dimmer is connected to the power input interface; and a first switch device, provided between the power input interface and the power output module, and configured to:

disconnect a circuit connection between the power input interface and the power output module if the dimmer detection module detects that a dimmer is connected to the power input interface, and conduct the circuit connection between the power input interface and the power output module if the dimmer detection module detects that no dimmer is connected to the power input interface.

2. The under cabinet light interface device as claimed in claim 1, wherein the power output module comprises:

an alternating current—alternating current conversion module, configured to convert the input alternating current into one or more output alternating currents;

one or more alternating current output interfaces, configured to output the one or more output alternating currents to one or more appliance connected to the one or more alternating current output interfaces;

an alternating current—direct current conversion module, configured to convert the input alternating current into a constant direct current;

a direct current output control module, configured to convert the constant direct current into one or more output direct currents; and one or more direct current output interfaces, configured to output the one or more output direct currents to one or more appliance connected to the one or more direct current output interfaces.

3. The under cabinet light interface device as claimed in claim 2, wherein at least one of the alternating current output interfaces is configured to be connectable to an under cabinet light and provide power to the under cabinet light.

4. The under cabinet light interface device as claimed in claim 1, wherein the power output module comprises:

a second switch device, provided between the first switch device and the alternating current—direct current conversion module, and configured to control closing or opening of a circuit between the first switch device and the power output module.

5. The under cabinet light interface device as claimed claim 1, further comprising an alarm device, the alarm device is configured to:

issue an alarm signal if the dimmer detection module detects that a dimmer is connected to the power input interface.

6. The under cabinet light interface device as claimed in claim 1, further comprising an overload protection device, the overload protection device is configured to:

acquire a power load value of the under cabinet light interface device;

compare the power load value with a safety load value of the under cabinet light interface device; and disconnect the circuit connection between the power input interface and the power output module if the power load value exceeds the safety load value of the under cabinet light interface device.

7. The under cabinet light interface device as claimed in claim 1, further comprising a wrong insertion protection device, the wrong insertion protection device is configured to:

detect whether an appliance connected to the power output module matches the power output module; and control the power output module not to output a current to the appliance which does not match if the appliance connected to the power output module does not match the power output module.

8. The under cabinet light interface device as claimed in claim 1, wherein the dimmer detection module is configured to:

acquire a predetermined waveform when a dimmer is connected to the power input interface;

detect an input waveform of the input alternating current; and compare whether the input waveform matches the predetermined waveform, so as to detect whether a dimmer is connected to the power input interface.

9. A lighting device interface device, comprising:

a power input interface, configured to be connected to a lighting device, so as to acquire an input alternating current from the lighting device;

a power output module, configured to receive, by means of a circuit, the input alternating current from the power input interface, convert the input alternating current into an output current, and output the output current to one or more appliances connected to the power output module;

a dimmer detection module, provided between the power input interface and the power output module, and configured to detect whether a dimmer is connected to the power input interface; and a first switch device, provided between the power input interface and the power output module, and configured to:

disconnect a circuit connection between the power input interface and the power output module if the dimmer detection module detects that a dimmer is connected to the power input interface, and conduct the circuit connection between the power input interface and the power output module if the dimmer detection module detects that no dimmer is connected to the power input interface.

10. The lighting device interface device as claimed in claim 9, wherein the power output module comprises:

an alternating current—alternating current conversion module, configured to convert the input alternating current into one or more output alternating currents;

one or more alternating current output interfaces, configured to output the one or more output alternating currents to one or more appliance connected to the one or more alternating current output interfaces;

an alternating current—direct current conversion module, configured to convert the input alternating current into a constant direct current;

a direct current output control module, configured to convert the constant direct current into one or more output direct currents; and one or more direct current output interfaces, configured to output the one or more output direct currents to one or more appliance connected to the one or more direct current output interfaces.

11. The lighting device interface device as claimed in claim 9, wherein the dimmer detection module is configured to:

acquire a predetermined waveform when a dimmer is connected to the power input interface;

detect an input waveform of the input alternating current; and compare whether the input waveform matches the predetermined waveform, so as to detect whether a dimmer is connected to the power input interface.

* * * * *